US008410345B2

(12) United States Patent
Patrick

(10) Patent No.: US 8,410,345 B2
(45) Date of Patent: Apr. 2, 2013

(54) TONE CONTROL DEVICE FOR PERCUSSION INSTRUMENTS

(76) Inventor: Chad David Patrick, Redlands, CA (US)

( * ) Notice: Subject to any disclaimer, the term of this patent is extended or adjusted under 35 U.S.C. 154(b) by 0 days.

(21) Appl. No.: 13/190,515

(22) Filed: Jul. 26, 2011

(65) Prior Publication Data

US 2012/0017746 A1 Jan. 26, 2012

Related U.S. Application Data

(60) Provisional application No. 61/400,297, filed on Jul. 26, 2010.

(51) Int. Cl.
*G10D 13/02* (2006.01)

(52) U.S. Cl. ..... 84/411 M; 84/422.4; 84/411 R

(58) Field of Classification Search ..... 84/411 R, 84/421, 422.4
See application file for complete search history.

(56) References Cited

U.S. PATENT DOCUMENTS

| | | | | |
|---|---|---|---|---|
| 4,154,137 | A | 5/1979 | Kobayashi | |
| 4,567,807 | A | 2/1986 | Robinson | |
| 4,745,839 | A | 5/1988 | Peraino | |
| 5,561,254 | A | 10/1996 | Huffer | |
| 5,581,030 | A * | 12/1996 | Conroy | 84/411 M |
| 5,637,819 | A | 6/1997 | Rogers | |
| 5,920,021 | A | 7/1999 | Good | |
| 6,291,754 | B1 | 9/2001 | Gatzen et al. | |
| 6,307,133 | B1 | 10/2001 | May et al. | |
| 6,586,664 | B1 | 7/2003 | Hubbell | |
| 6,696,630 | B2 | 2/2004 | Gatzen | |

* cited by examiner

*Primary Examiner* — Kimberly Lockett

(57) ABSTRACT

Herein described is a tone control device for percussion instruments comprising a first strap, a second strap, a weighted member and an engagement loop for the convenient engagement of a drum stick or other striking implement. The device attaches to a percussion instrument in such a manner as to allow a user to apply the tone control device to the percussion instrument's strike surface efficiently and conveniently with minimal disruption in play.

10 Claims, 5 Drawing Sheets

TONE CONTROL DEVICE FOR PERCUSSION INSTRUMENTS

This application claims the benefit of U.S. Provisional Application No. 61/400,297 filed Jul. 26, 2010.

BACKGROUND OF THE INVENTION

The percussion family is made up of instruments that are struck with a stick, mallet, hand, brush or other means creating sound. There is usually a surface that is struck and the sound waves often travel through a chamber, tube, or shell to allow the vibration to resonate. Drums are the most recognized of the instruments in this family.

Throughout history the standard drum consisted of a simple hollowed out log or a gourd with a piece of animal skin stretched taunt. Sticks and bones were used as beaters and together they could create a wide variety of tonal colors and contrasts. Different skin tensions also were created to achieve unique sounds and tones.

One of the most dynamic and impactful modern drum developments has been the snare drum. The snare drum is known as an instrument with indefinite pitch. Indeed, the tone of a snare drum is very difficult to change without a tool or drum key. By comparison, other pitched instruments are fairly easy to change with tuning slides, tuning pegs, fine tuners, mouth piece adjustments and so on.

Around the turn of the $20^{th}$ century, the snare drum's popularity increased with the rise of bugle corps. Metal counter hoops were added to tighten the drumheads more efficiently. The original tabor or gut snare was replaced with a coiled wire snare—the material still used today. Drum head composition also changed and moved to a synthetic skin often made up of Mylar or other plastic based products.

Many major recording studios have used 'tone control' types of devices for improving a drum's sound. The true sound of a drum is more apparent when you reduce problem frequencies, unwanted overtones, and ringing. Once these problems are addressed, the resulting tone is noticeably more pleasing to the ear.

Drummers greatly benefit from rapid, convenient, efficient tone control in situations such as live performances or in studio contexts. One type of common tone control is muffling the drum using a device to control ring and unwanted overtone frequencies.

There are dozens of products on the market used for tone control. These products do a decent job of changing or modifying tone, but the current products often change the sound too much, in essence "choking' the sound out of the drum. Furthermore, the products on the market are not easily removed and re-applied in the middle of a song without devoting a hand to do so. This is very important as both hands of the drummer are busy during a song and removing the stick from the hand makes the drummer prone to mistakes and unwanted tempo changes. Drummers often transfer sticks from their hand to mouth, underarms, or any other method to get a free hand. This can be challenging during a songs since a drummer's arms, legs, hands, wrists, feet, shoulders, and torso are all in motion.

There are a many products currently on the market that attempt to address these issues falling within the following general categories: after market rings ("AMR"), built in rings ("BIR"), adhesive based products, add-on mechanical, built in mechanical muffling devices, and add-on gravity based devices. As explained below, the available products have substantial shortcomings.

For years AMRs were the mainstay in the market. AMRs are shaped like a perfect circle or ring and come in different sizes, thicknesses, and diameters. AMRs are very difficult to get off of your drum in a rush without damaging them or creasing them. For example, a drummer must pinch the ring with her forgers, or poke at it with her stick to remove the ring during a song. Once the ring is removed the drummer must find a place for the ring. Therefore, AMRs fail to promote smooth, quick transitions of the muffling device. They also are difficult to reinstall on the drum head, due to their awkward shape, pliability and size.

BIRs are manufactured into the drum head. Many companies have successfully introduced drum heads that improve the sound over those heads manufactured in the past, by adding another layer or ring of Mylar onto the back side of the head. Other companies have introduced venting and other ring type products to contain over ring into a built-in ring format. Unfortunately, these products do not allow the drummer to change the amount of tone control muffling without removing heads which forces retuning.

Many adhesive products are removable, re-usable and offer great concepts for marketing and commercializing their products. However, the exclusive use of an adhesive device means that the attack of the stick is somewhat compromised and sound is a game of microns, and micro seconds. These adhesive products are also difficult to remove, reapply, reattach, and store while not in use. The amount of time it takes to remove, let alone reapply it, is too long for an easy mid-song transition. When removed they must be stored somewhere and if they fall to the floor they often pick up dust, hair, and other unwanted materials reducing their sticking ability.

Add-on and built-in mechanical devices offer adjustability in the drum's muffled sound as well as some fine tuning. However, quick changes are virtually impossible with most of these products. Most add-on mechanical devices must be removed when the drums are packed and transported.

The add-on gravity based tone control devices utilize gravity to muffle the tone. They are often attached to the hardware of the drum, either on the rim or external hardware such as tension rods or lugs. Some are tethered and others use hook and loop fasteners to attach. The major problem with these devices as well, is the removability and ease of re-application of the products mid-song.

Before the rise of these products drummers employed a variety of creative techniques to control tone. For example, duct tape was used, sometimes in combination with tissue or paper towels. Drummers additionally used towels, clothing, and even certain feminine products to achieve the desired tones out of their drums.

Drummers have also used the common wallet for decades. Many famous drummers have used their wallets in live and/or studio applications to control the over-ring from their drum and the undesirable overtones that accompany that ring. The drummer's wallet is usually placed on the edge of the drum near the rim, sometimes open and hanging over the rim, and sometimes closed and resting against the rim.

The mass of the wallet stops the head from vibrating as intensely after being struck. This action occurs due to the amount of surface area in contact with the drumhead among other physical factors. The wallet still allows for the initial attack to be true and unaffected due to the split second that the wallet spends in mid-air away from the head because of the percussive wave of the initial drum stick stroke. The wallet falls back to the head, thus cancelling out any unwanted reverberations by dampening the head with its mass.

There is a need for a percussion instrument tone control device that ably cancels out unwanted overtones and dissonant ringing in an instrument and yields a great sounding, bright stick attack tone. Further, there is a need for a device that offers convenient and quick attachment, application, removal, and a simplified means of engagement. There is also a need for a device that is versatile and that easily fits most percussion instruments on the market.

BRIEF DESCRIPTION OF THE DRAWINGS

An embodiment of the invention will now be described with reference to the accompanying drawings, in which.

BRIEF SUMMARY OF THE INVENTION

In accordance with the first aspect of the present invention, there is provided a tone control device for a percussion instrument. In one embodiment, the percussion instrument is a drum.

The tone control device of the present invention comprises a first strap, a second strap, an engagement loop, and a weighted member. In one embodiment, the first strap comprises an attachment means, such as Velcro or hook and loop structures for convenient attachment to the percussion instrument. In another embodiment of the present invention, the attachment means of the first strap attaches to the tension rods of the drum. In yet another embodiment of the present invention, the first strap is attached to the percussion instrument such that it is positioned between the tension rods and the outer surface of the percussion instrument.

The tone control device furthermore comprises a second strap. The second strap is attached to the first strap and positioned perpendicular to the first strap. In one embodiment, the second strap is attached to the first strap at the first strap's mid section. The second strap of the present invention may be attached to the first strap by any means. For example, in one embodiment, the second strap is stitched or sewn to first strap. The second strap is furthermore attached to a weighted member as explained in more detail below.

The tone control device of the present invention also comprises an engagement loop. In one embodiment, the engagement loop is formed from the second strap and the weighted member. The tone control device of the present invention is preferably attached to the percussion instrument such that the engagement loop faces the percussion instrument's outer shell when disengaged.

The tone control device additionally comprises a weighted member. In one embodiment, the weighted member comprises a chamber. In another embodiment of the present invention, the chamber of the weighted member comprises a filler and in another embodiment the filler is granulated aluminum. However, the filler may be of any material known to those of skill in the art. The tone control device of the present invention is preferably attached to the percussion instrument such the first face of the weighted member faces away from the percussion instrument.

DESCRIPTION OF REPRESENTATIVE EMBODIMENTS

Further scope of applicability of the present invention will become apparent from the detailed description given herein. However, it should be understood that the detailed description and specific examples, while indicating embodiments of the invention, are given by way of illustration only, since various changes and modifications within the spirit and scope of the invention will become apparent to those skilled in the art.

Figure 1A:
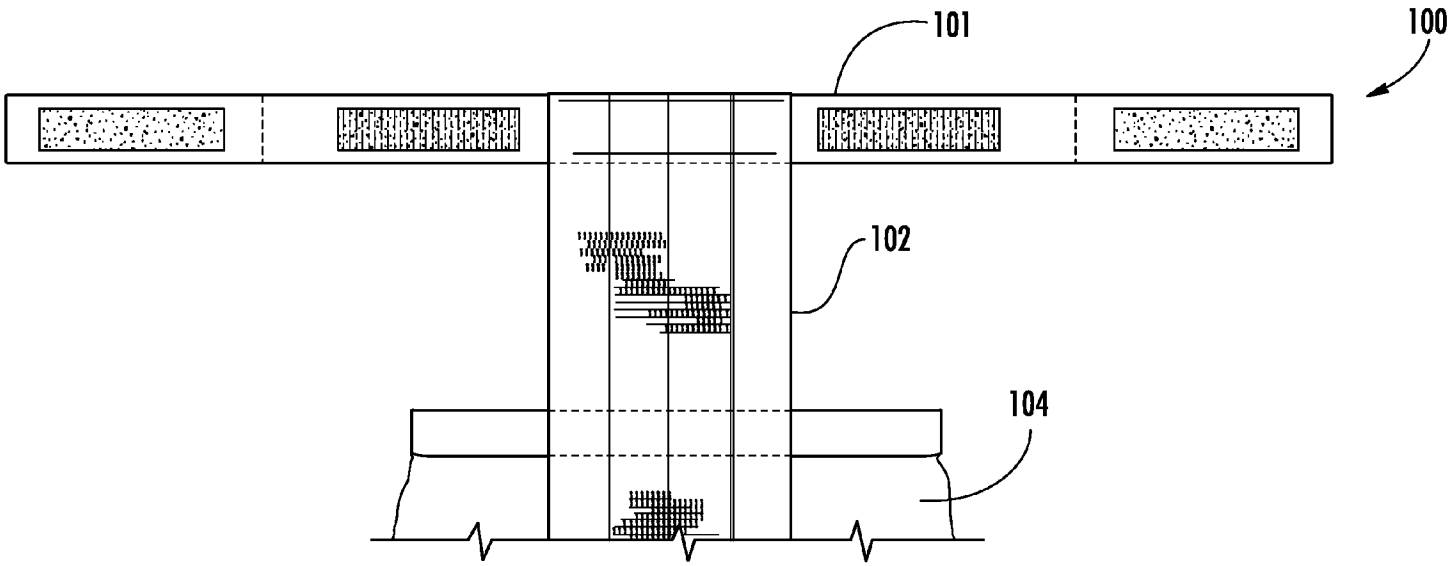
FIG. 1A depicts a top half frontal view of the tone control device.
Figure 1B:
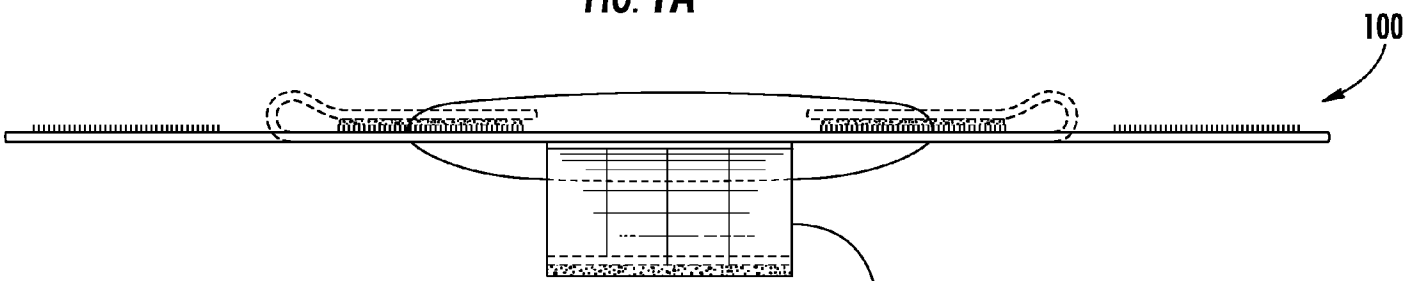
FIG. 1B depicts an overhead view of the tone control device.
Figure 2A:
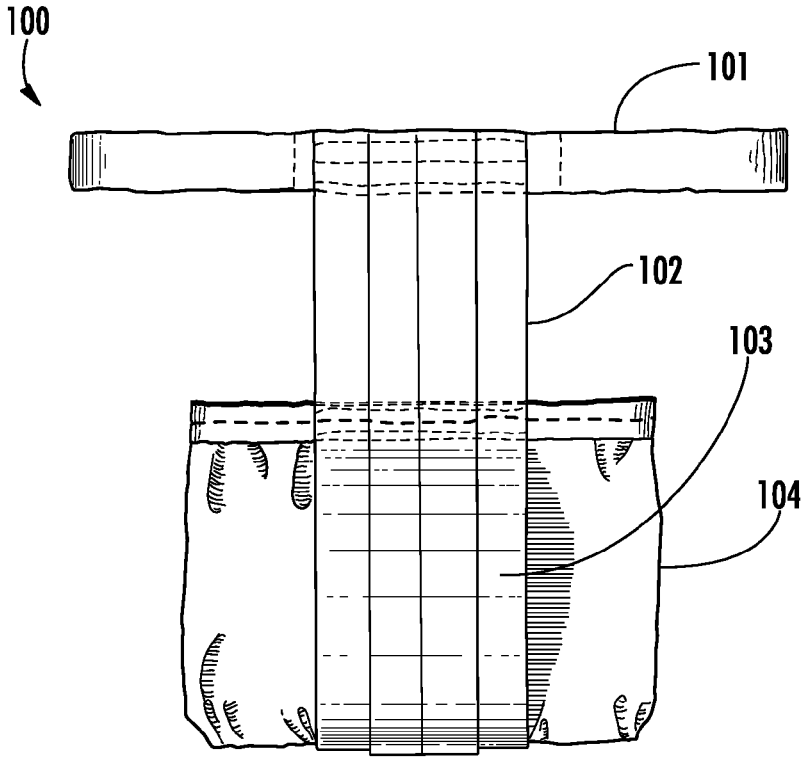
FIG. 2A depicts a full frontal view of the device illustrating the pocket side.
Figure 2B:
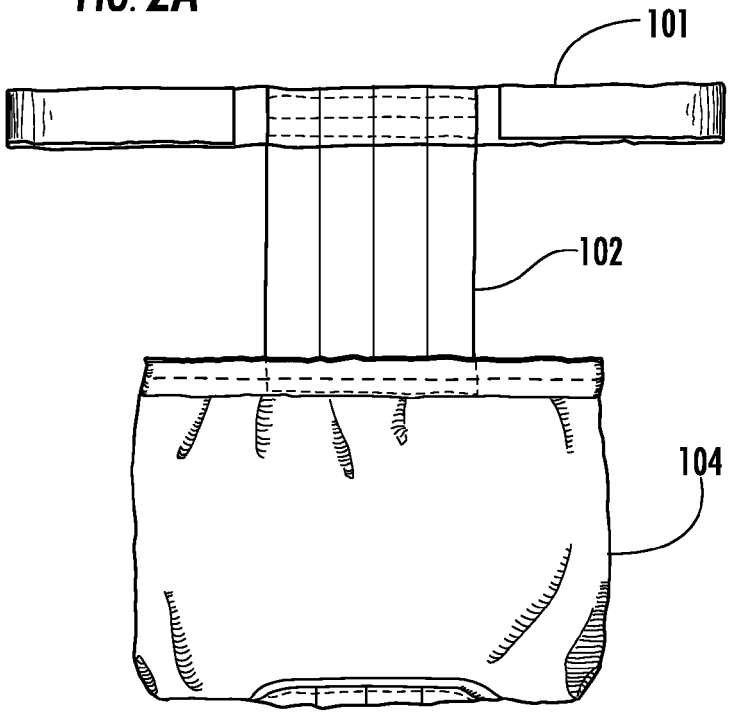
FIG. 2B depicts a full back side view of the device showing the adjustable strapping in the applied or engaged position.

Referring now to FIGS. 1-5, a tone control device 100 is generally shown. FIG. 1A illustrates a frontal view of the top portion of the tone control device 100 and shows a first strap 101, a second strap 102, engagement loop 103, and weighted member 104. Referring now to FIG. 2, a front (FIG. 2A) and back (FIG. 2B) view of the tone control device is shown. In FIG. 2A, the relationship between engagement loop 103 and weighted member 104 is depicted in more detail.

Figure 4A:
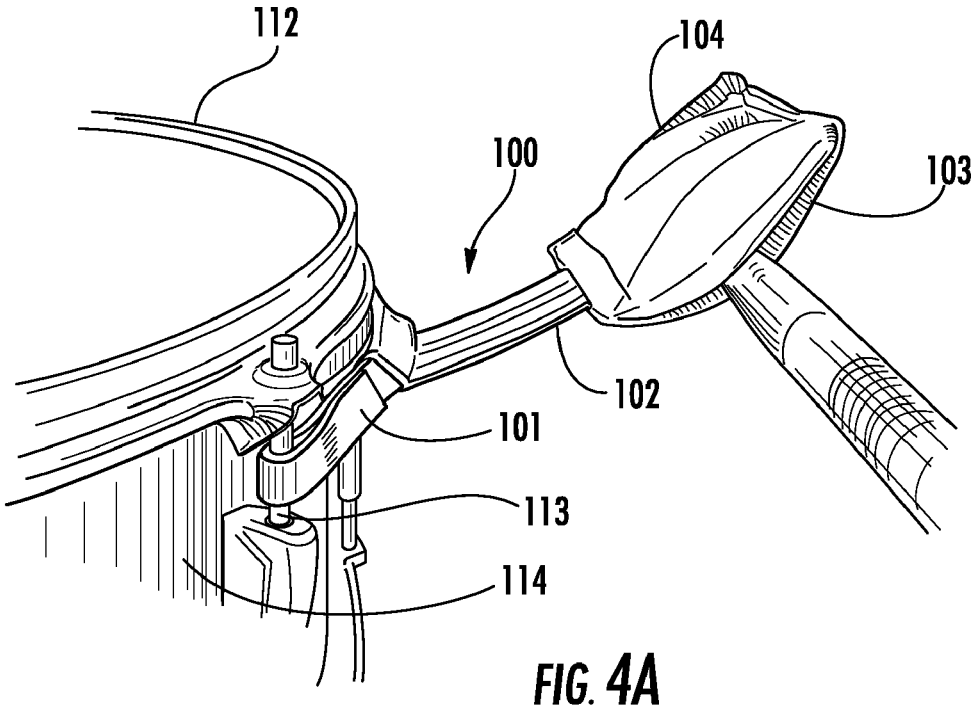
FIG. 4A depicts an embodiment of the tone control device for percussion instruments with a drum stick positively engaged with the device and actively applying or removing the device.
Figure 4B:
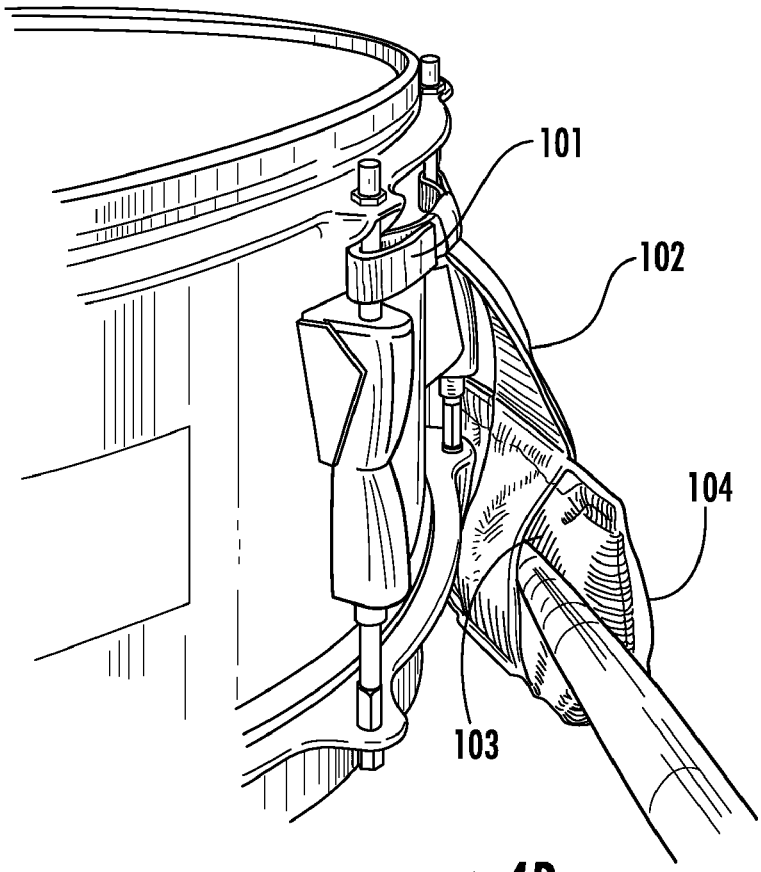
FIG. 4B depicts an embodiment of the tone control device for percussion instruments engaged by a drumstick and with the weighted member disengaged.
Figure 5A:
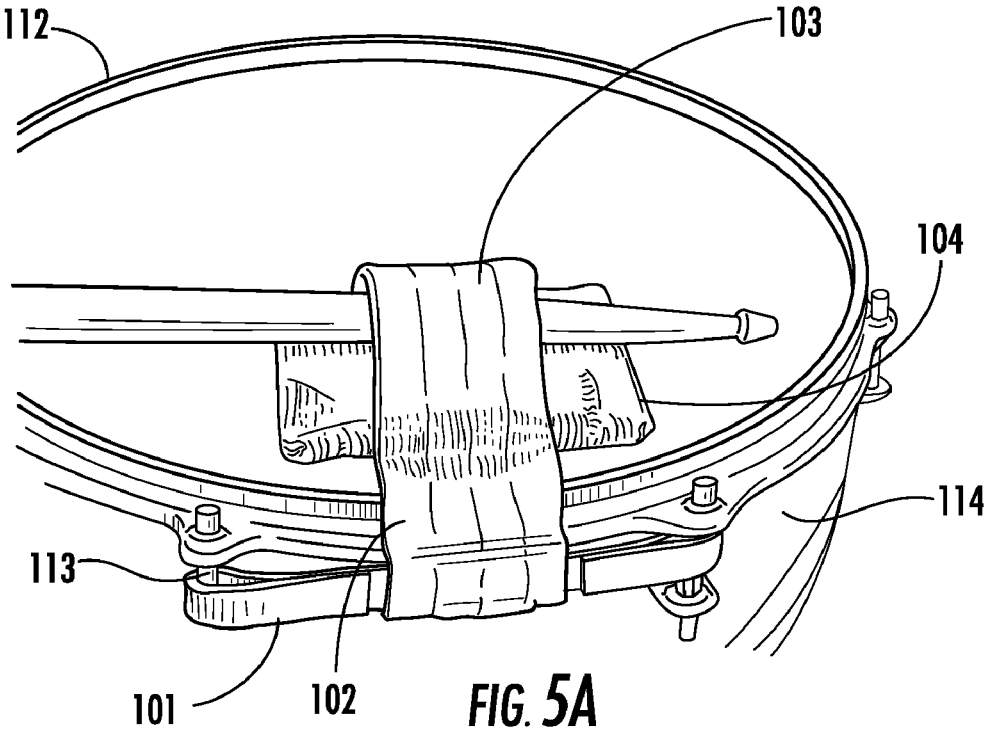
FIG. 5A depicts an embodiment of the tone control device for percussion instruments with the weighted member engaged with the drum head.
Figure 5B:
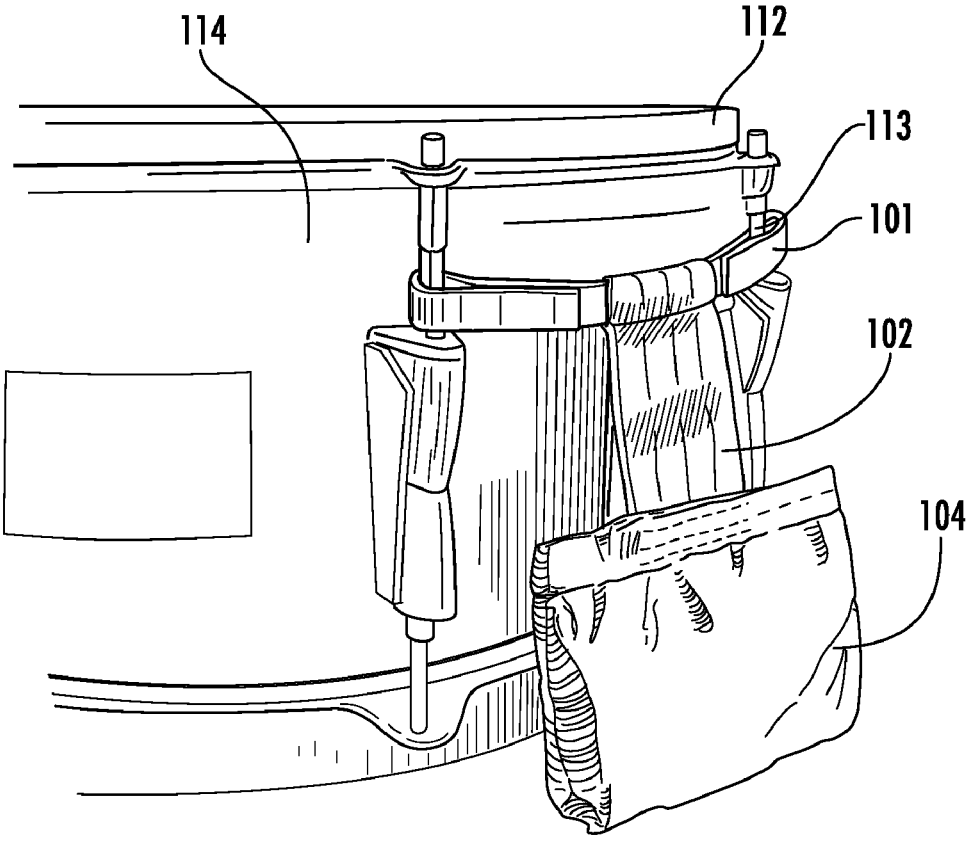
FIG. 5B depicts an embodiment of the tone control device with the weighted member disengaged from the drum head.

As illustrated in FIGS. 4 and 5, first strap 101 attaches the tone control device 100 to a any percussion instrument, which in FIGS. 4 and 5 is a drum 112. First strap 101 may be adapted for easy attachment between the tension rods 113 of the drum and the shell 114 of the drum as shown in the embodiment depicted in FIGS. 4 and 5. The tone control device 100 may attach to a percussion instrument in any manner using the first strap 101. When first strap 101 is designed to attach between tension rods and the shell as depicted in FIGS. 4 and 5, first strap 101 should be narrow enough to allow for easy attachment, but wide enough to support the weight of the remaining parts, including weighted member 104.

First strap 101 may be of any design as long as it permits convenient removal from and re-attachment to the percussion instrument of the user's choice. First strap 101 may additionally be adjustable. For example, first strap 101 may comprise fasteners 105 that attach the tone control device 100 to the instrument. FIGS. 1 and 2 show fasteners 105 that are hook and loop or Velcro. First strap 101 may be comprised of any material known to those of skill in the art including hemp, nylon, leather, vinyl, cotton, Kevlar, canvas, or polyester.

Fasteners 105 may be adjustable or non-adjustable depending on the user's needs. In one embodiment, fasteners 105 are adjustable and arranged so that the user can adjust them while attaching them to the percussion instrument of choice. This type of fastener works best to allow for overlapping of the strapping to still maintain adherence and closure. This helps to assure the attachment of tone control device 100 to any size instrument with standard hardware.

First strap 101 is connected to second strap 102. In the embodiment depicted in FIG. 1, first strap 101 is connected to second strap 102 in the central area of strap 101. FIG. 1 shows that the second strap 102 extends perpendicular to the first strap 101, wherein in disengaged position, second strap 102 hangs downward toward the floor or other surface upon which the instrument rests. Second strap 102 may be connected to first strap 101 in any manner known to those of skill in the art. For example, second strap 102 may be sewn, riveted, or stapled to first strap 101.

Second strap 102 is used to suspend the tone control device 100 at the side of the drum when fully disengaged with the percussion instrument's playing surface. Second strap is additionally used to stabilize the tone control device 100 when the user is actively engaging the device 100 with the percussion instrument's playing surface and when the user is disengaging the device 100 with the playing surface.

Second strap 102 may be made of any material as long as it is flexible, durable, and meets manufacturing specifications. Second strap 102 must allow for stable movement of the tone control device 100 between engaged and disengaged positions. The material may be comprised of hemp, nylon, leather, vinyl, cotton, Kevlar, canvas, polyester or the like, and must be wide enough to support the product and reduce twist of the tone control device 100 to keep it in position to be engaged by the user.

Figure 3B:
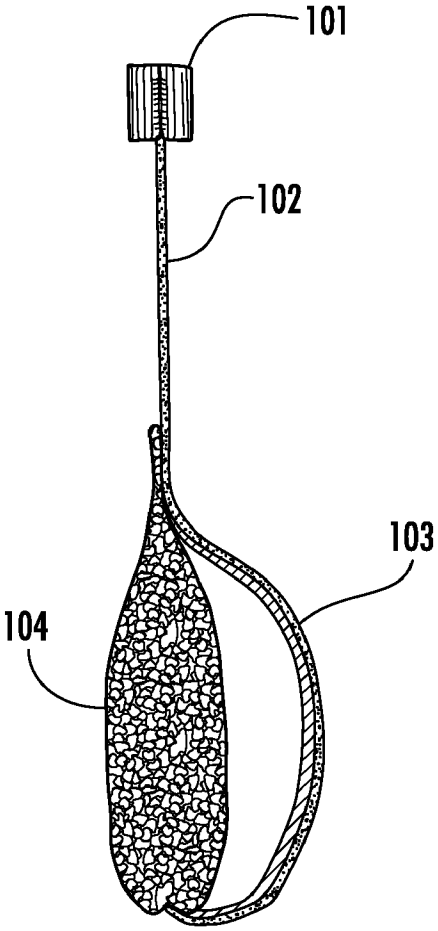
FIGS. 3A and 3B depict a side view of an embodiment of the tone control device for percussion instruments.
Figure 3A:
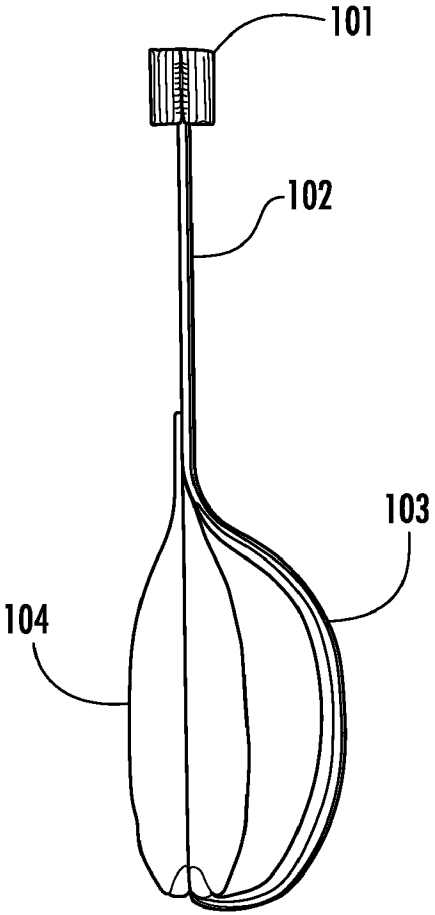

Referring now to FIG. 3, second strap 102 is connected to the central portion of first strap 101 by sewing or other means and extends downward toward the floor or other supporting surface perpendicular to first strap 101. Attachment in such a manner allows for the tone control device 100 to hang below first strap 101 while disengaged at rest between lugs, tension rods, or other attachment point.

The embodiment depicted in FIG. 2A shows the bottom portion of second strap 102 connected to a weighted member 104. Weighted member 104 has a first face 106 and a second face 107. FIG. 2A shows second strap 102 attached to weighted member 104 at the top and bottom of member 104. In this embodiment, second strap 102 is sewn or stitched to member 104, but second strap 102 may be connected to member 104 by any means known to those of skill in the art. Attachment of second strap 102 to member 104 at the top and bottom of the first face 106 of member 104 creates engagement loop 103. The vacancy between second strap 102 and first face 106 of member 104 at engagement loop 103 is large enough for convenient insertion of a drum stick, mallet, brush or other percussion striking instrument. It is understood that the bottom and top portion of strap 102 may be manufactured as a single piece or separate pieces. In a further embodiment, the weighted member 104 may comprise a pocket or pockets on either the first face or second face of weighted member 104 if the user wishes to store items in the tone control device.

A user engages engagement loop 103 using his/her drum stick, mallet, brush, or other striking instrument used to play drums, or simply by using their hand. Engagement loop 103 may be accessible from either end through openings 108 or 109 for left and/or right handed players. Engagement loop 103 may include a secondary material that promotes the insertion of the striking instrument without chipping or splintering the instrument. Alternatively, the secondary material may help to prevent a striking instrument, or used drum stick that has already been damaged or splintered from hanging up in the engagement loop 103.

Engagement loop 103 may be attached to either side of member 104. In the embodiment illustrated in FIGS. 4 and 5, engagement loop is attached to the side of member 104 adjacent to drum shell in a fully disengaged position. Positioning the engagement loop in this manner allows the user to engage the engagement loop 103 with the striking instrument of choice and lift the weighted member 104 to the engaged position, such that weighted member 104 is in direct optimal contact with the percussion instrument surface.

An embodiment of weighted member 104 is illustrated best in FIG. 3 which shows a side view of the tone control device 100. As shown in FIG. 3, weighted member 104 comprises a chamber 110. Weighted member 104 is the component of the tone control device 100 that contacts the striking surface of the percussion instrument when the device 100 is in the engaged position helping to muffle unwanted tones. Preferably, second face 107 of weighted member 104, or the face of the weighted member 104 that does not attach engagement loop 103 contacts the striking surface. Member 104 is preferably designed to minimize bounce and absorb the vibration generated when the user strikes the striking surface of the percussion instrument. Member 104 is preferably weighted.

In one embodiment, chamber 110 of weighted member 104 is filled with material including fragments or granulates. Alternatively, the chamber 110 of weighted member may contain a solid insert. Types of filler material that may be desirable for the purposes of this invention include granulated aluminum, sand, steel or any other item or material that is non hazardous to the user provided it meets the manufacturing standards for weight and physical characteristics.

The amount or weight of filler material that fills chamber 110 varies according to the desired muffling or damping that the user wishes to achieve and furthermore depends on the type of filler material used. According to one embodiment of the present invention, the weight of the filler material in chamber 110 is between about 1 and 6 ounces. In another embodiment of the present invention, the weight is between about 2 and 4 ounces. In another embodiment of the present invention, the weight of the filler material is 4 ounces.

Chamber 110 may additionally contain an access 111 for in case the user wishes to change the weight of weighted member 104. Access 111 may be sealed by Velcro, metal snaps, buttons or the like to prevent the filler content from escaping during use. As with most of the components of the tone control device 100, member 104 may be made of the same, or other flexible, durable materials, such as but not limited to: hemp, nylon, polyester, Kevlar, canvas, cotton, or vinyl.

It will be realized that the foregoing embodiment of the present invention has been shown and described for the purposes of illustrating the functional and structural principles of this invention and are subject to change without departure to such principles. Therefore, this invention includes all modifications encompassed within the spirit and scope of the following claims.

What is claimed is:

1. A tone control device for a percussion instrument comprising:

a first strap;

a second strap;

an engagement loop comprising an opening for insertion of a striking instrument positioned facing the shell of the drum when said tone control device is fully disengaged; and a weighted member comprising a chamber, a first face, and a second face.

2. The one control device of claim 1 wherein said chamber of said weighted member comprises a filler.

3. The tone control device of claim 1 wherein said second face of weighted member is positioned facing away from the drum shell when said tone control device is fully disengaged.

4. A tone control device for a percussion instrument comprising:

a first strap;

a second strap;

an engagement loop comprising an opening for insertion of a striking instrument and is positioned facing the shell of the drum when said tone control device is fully disengaged;

a weighted member comprising a chamber, a first face, a second face, and a filler comprising granulated aluminum; and wherein said weighted member when fully engaged with the percussion instrument striking surface absorbs the vibration generated from striking the percussion instrument striking surface and muffles unwanted tones.

5. The tone control device of claim 4 wherein said weighted member comprises between about 2 and about 6 ounces of filler.

6. The tone control device of claim 4 wherein said weighted member comprises 4 ounces of filler.

7. The tone control device of claim 4 wherein said second face is positioned facing away from the drum shell when said tone control device is fully disengaged.

8. A tone control device for a drum comprising:

a first strap that attaches to tension rods of a drum wherein said first strap is positioned between said tension rods and drum shell;

a second strap;

an engagement loop comprising an opening for insertion of a striking instrument and positioned facing the shell of the drain when said tone control device is fully disengaged; and a weighted member comprising a chamber, a first face, a second face, and between about 2 and about 6 ounces of a filler comprising granulated aluminum.

9. The tone control device of claim 8 wherein the first strap further comprises a hook and loop attachment mechanism.

10. The tone control device of claim 8 wherein said second face is positioned facing away from the drum shell when said tone control device is fully disengaged.

* * * * *